US009051827B1

(12) United States Patent
Harrison

(10) Patent No.: US 9,051,827 B1
(45) Date of Patent: Jun. 9, 2015

(54) SELECTIVE REMOVAL OF SILICA FROM SILICA CONTAINING BRINES

(75) Inventor: Stephen Harrison, Benicia, CA (US)

(73) Assignee: Simbol Mining Corporation, Pleasanton, CA (US)

( * ) Notice: Subject to any disclaimer, the term of this patent is extended or adjusted under 35 U.S.C. 154(b) by 513 days.

(21) Appl. No.: 12/823,000

(22) Filed: Jun. 24, 2010

Related U.S. Application Data

(60) Provisional application No. 61/239,275, filed on Sep. 2, 2009.

(51) Int. Cl.
*E21B 43/16* (2006.01)
*E21B 43/25* (2006.01)

(52) U.S. Cl.
CPC *E21B 43/16* (2013.01); *E21B 43/25* (2013.01)
USPC ..... 166/305.1; 166/279

(58) Field of Classification Search
CPC ..... E21B 43/16; E21B 43/25
USPC ..... 166/305.1, 222, 294, 295
See application file for complete search history.

(56) References Cited

U.S. PATENT DOCUMENTS

| | | | | |
|---|---|---|---|---|
| 2,964,381 | A | 12/1960 | Goodenough | |
| 3,306,700 | A | 2/1967 | Neipert | |
| 3,321,268 | A | 5/1967 | Copson | |
| 3,523,751 | A | 8/1970 | Burkert | |
| 4,016,075 | A * | 4/1977 | Wilkins | 210/712 |
| 4,036,713 | A | 7/1977 | Brown | |
| 4,116,856 | A | 9/1978 | Lee et al. | |
| 4,116,858 | A | 9/1978 | Lee et al. | |
| 4,142,950 | A | 3/1979 | Creamer | |
| 4,159,311 | A | 6/1979 | Lee et al. | |
| 4,209,369 | A | 6/1980 | Seko | |
| 4,221,767 | A | 9/1980 | Lee et al. | |
| 4,251,338 | A | 2/1981 | Retallack | |
| 4,276,180 | A * | 6/1981 | Matson | 210/683 |
| 4,291,001 | A | 9/1981 | Repsher et al. | |
| 4,347,327 | A | 8/1982 | Lee et al. | |
| 4,348,295 | A | 9/1982 | Burba, III | |
| 4,348,296 | A | 9/1982 | Bauman et al. | |
| 4,348,297 | A | 9/1982 | Bauman et al. | |
| 4,376,100 | A | 3/1983 | Lee et al. | |
| 4,381,349 | A | 4/1983 | Lee | |

(Continued)

FOREIGN PATENT DOCUMENTS

| | | |
|---|---|---|
| DE | 19631794 | 7/1997 |
| DE | 19809420 | 9/1999 |

(Continued)

OTHER PUBLICATIONS

Chiba et al (JP55031437), Removal of Arsenic and Silicon Dioxide Contained in Industrial Waste Water, 1980, 19 pages.

(Continued)

*Primary Examiner* — Zakiya W Bates
*Assistant Examiner* — Silvana Runyan
(74) *Attorney, Agent, or Firm* — Fish & Tsang, LLP

(57) ABSTRACT

A method for selective removal and recovery of silica and silicon containing compounds from solutions that include silica and silicon containing compounds, including geothermal brines. Also included are methods of preventing silica scale buildup in the geothermal power equipment and processes employing geothermal brines by the selective removal of silica.

16 Claims, 2 Drawing Sheets

(56) References Cited

U.S. PATENT DOCUMENTS

| | | | | |
|---|---|---|---|---|
| 4,405,463 | A * | 9/1983 | Jost et al. | 210/712 |
| 4,405,595 | A | 9/1983 | Yang | |
| 4,430,311 | A | 2/1984 | Lee et al. | |
| 4,461,714 | A | 7/1984 | Burba, III | |
| 4,472,362 | A | 9/1984 | Burba, III | |
| 4,477,367 | A | 10/1984 | Burba | |
| 4,540,509 | A | 9/1985 | Burba, III | |
| 4,727,167 | A | 2/1988 | Burba, III et al. | |
| 4,745,977 | A * | 5/1988 | Love et al. | 166/369 |
| 4,762,656 | A | 8/1988 | Ballard | |
| 5,015,541 | A | 5/1991 | Evans | |
| 5,135,652 | A | 8/1992 | Boateng | |
| 5,145,656 | A * | 9/1992 | Gallup et al. | 423/42 |
| 5,200,165 | A | 4/1993 | Harper | |
| 5,219,550 | A | 6/1993 | Brown | |
| 5,229,003 | A | 7/1993 | Duyvesteyn | |
| 5,244,491 | A | 9/1993 | Brown | |
| 5,246,684 | A | 9/1993 | Brown | |
| 5,254,225 | A | 10/1993 | Gallup | |
| 5,358,700 | A | 10/1994 | Brown et al. | |
| 5,389,349 | A | 2/1995 | Bauman et al. | |
| 5,427,691 | A | 6/1995 | Kuyucak et al. | |
| 5,441,712 | A | 8/1995 | Duyvesteyn et al. | |
| 5,594,923 | A | 1/1997 | Inoue | |
| 5,599,516 | A | 2/1997 | Bauman et al. | |
| 5,656,172 | A | 8/1997 | Kitz | |
| 5,711,019 | A | 1/1998 | Tomczuk | |
| 5,833,844 | A | 11/1998 | Leavitt | |
| 5,904,653 | A | 5/1999 | Hatfield | |
| 5,919,287 | A | 7/1999 | Moreau | |
| 5,932,644 | A | 8/1999 | Fujii | |
| 5,935,541 | A | 8/1999 | Bonnet | |
| 5,939,043 | A | 8/1999 | Yahagi | |
| 5,951,843 | A | 9/1999 | Itoh | |
| 5,993,759 | A | 11/1999 | Wilkomirsky | |
| 5,997,836 | A | 12/1999 | Sato | |
| 6,017,500 | A | 1/2000 | Mehta | |
| 6,048,507 | A | 4/2000 | Amouzegar | |
| 6,080,696 | A | 6/2000 | Duke et al. | |
| 6,103,422 | A | 8/2000 | Kanai | |
| 6,139,498 | A | 10/2000 | Katsman | |
| 6,170,037 | B1 | 1/2001 | Blumenau | |
| 6,207,126 | B1 | 3/2001 | Boryta | |
| 6,219,311 | B1 | 4/2001 | Mitsuno | |
| 6,280,693 | B1 | 8/2001 | Bauman et al. | |
| 6,458,184 | B2 | 10/2002 | Featherstone | |
| 6,555,078 | B1 | 4/2003 | Mehta | |
| 6,682,644 | B2 | 1/2004 | Featherstone | |
| 6,770,187 | B1 | 8/2004 | Putter | |
| 7,026,072 | B2 | 4/2006 | Barker | |
| 7,060,238 | B2 | 6/2006 | Saidi | |
| 7,330,914 | B2 | 2/2008 | Inogai | |
| 7,390,466 | B2 | 6/2008 | Boryta | |
| 7,504,036 | B2 | 3/2009 | Gottlieb | |
| 7,678,470 | B2 | 3/2010 | Yoon | |
| 7,708,972 | B2 | 5/2010 | Coustry | |
| 7,824,766 | B2 | 11/2010 | Eplee | |
| 8,197,707 | B2 | 6/2012 | Lefenfeld | |
| 8,287,829 | B2 | 10/2012 | Harrison | |
| 8,309,043 | B2 | 11/2012 | Alurralde | |
| 8,435,468 | B2 | 5/2013 | Harrison | |
| 8,454,816 | B1 | 6/2013 | Harrison | |
| 8,518,232 | B1 | 8/2013 | Harrison | |
| 8,574,519 | B2 | 11/2013 | Harrison | |
| 2001/0000597 | A1 | 5/2001 | Featherstone | |
| 2001/0028871 | A1 | 10/2001 | Harrison | |
| 2002/0018929 | A1 | 2/2002 | Dai | |
| 2003/0226761 | A1 | 12/2003 | Featherstone et al. | |
| 2003/0228251 | A1 | 12/2003 | Boryta | |
| 2004/0005267 | A1 | 1/2004 | Boryta | |
| 2004/0018135 | A1 | 1/2004 | Adamson | |
| 2004/0149590 | A1 | 8/2004 | Featherstone et al. | |
| 2004/0264338 | A1 | 12/2004 | Chou | |
| 2005/0011753 | A1 | 1/2005 | Jackson | |
| 2005/0162990 | A1 | 7/2005 | Murata | |
| 2005/0265909 | A1 | 12/2005 | Kajiya | |
| 2006/0093911 | A1 | 5/2006 | Chiga | |
| 2006/0115396 | A1 | 6/2006 | Boryta | |
| 2006/0115407 | A1 | 6/2006 | Boryta | |
| 2006/0115410 | A1 | 6/2006 | Boryta | |
| 2007/0114134 | A1 | 5/2007 | Legg | |
| 2007/0148077 | A1 | 6/2007 | Boryta | |
| 2007/0160516 | A1 | 7/2007 | Boryta | |
| 2008/0068963 | A1 | 3/2008 | Shikata | |
| 2008/0221440 | A1 | 9/2008 | Iddan | |
| 2008/0233042 | A1 | 9/2008 | Boryta | |
| 2008/0249395 | A1 | 10/2008 | Shachar | |
| 2008/0300589 | A1 | 12/2008 | Paul | |
| 2009/0107230 | A1 | 4/2009 | Okcay | |
| 2009/0214414 | A1 | 8/2009 | Boryta | |
| 2009/0264777 | A1 | 10/2009 | Markowitz | |
| 2009/0275827 | A1 | 11/2009 | Aiken | |
| 2010/0000597 | A1 | 1/2010 | Cousins | |
| 2010/0099991 | A1 | 4/2010 | Snyder | |
| 2010/0165672 | A1 | 7/2010 | Li | |
| 2010/0172554 | A1 | 7/2010 | Kassab | |
| 2010/0301267 | A1 | 12/2010 | Mao | |
| 2010/0312095 | A1 | 12/2010 | Jenkins | |
| 2010/0312096 | A1 | 12/2010 | Guttman | |
| 2010/0327223 | A1 | 12/2010 | Zaghib | |
| 2011/0044882 | A1 | 2/2011 | Buckley | |
| 2011/0123427 | A1 | 5/2011 | Boryta | |
| 2011/0200508 | A1 | 8/2011 | Harrison | |
| 2012/0235084 | A1 | 9/2012 | Lefenfeld | |

FOREIGN PATENT DOCUMENTS

| | | |
|---|---|---|
| EP | 0103035 | 3/1984 |
| EP | 0117316 | 8/1986 |
| EP | 0094983 | 12/1989 |
| EP | 1900688 | 3/2008 |
| GB | 895690 | 5/1962 |
| GB | 2190668 | 11/1987 |
| JP | 52009963 A | 1/1977 |
| JP | 55031437 | 3/1980 |
| WO | 9419280 | 9/1994 |
| WO | 9929624 | 6/1999 |
| WO | 0078675 | 12/2000 |
| WO | 03037794 | 5/2003 |
| WO | 03041857 | 5/2003 |
| WO | 2006094968 | 9/2006 |
| WO | 2009131628 | 10/2009 |

OTHER PUBLICATIONS

ABE, Synthetic Inorganic Ion-Exchange Materials, XXXIV, Selective Separation of Lithium from Seawater by Tin(IV) Antimonate CatioN Exchanger, Hydrometallurgy, 1984, pp. 83-93, vol. 12, Elsevier Science Publications B.V. Amsterdam, The Netherlands.

Bloomquist, Economic Benefits of Mineral Extraction from Geothermal Brines, Proceedings of the Sohn International Sympoium, Aug. 27-31, 2006, vol. 6, pp. 553-558.

Cole, Zinc Solvent Extraction in The Process Indsutries, 24(2), Mineral Proc. & Extractive Metallurgy Rev. (2003), pp. 91-137.

Dreisinger, New Developments in the Boleo Copper-Cobalt-Zinc-Manganese Project.

Fuji, Dependence of adsoptive capabaility for lithium ions in molten salt on surface properties of activated alumina, Nippon Seramikkusus Kyokai Gakujutsu Ronbunshi, 1994, p. 12, vol. 102, Japan.

Gallup, Laboratory investigation of silica removal from geothermal brines to control silica scaling and produce usable silicates, Applied Geochemistry, 2003, pp. 1597-1616, vol. 18, Elsevier, US.

Gotfryd, Recovery of Zinc(II) from Acidic Sulfate Solutions, Simulation of Counter-Current Extraction Stripping Process 38 Physiochemical Problems of Mineral Processing (2004), pp. 113-120.

Hamzaoui, Lithium recovery from highly concentrated solutions: Response surface methodology (RSM) process parameters optimizations, Hydrometallurgy, 2008, pp. 1-7, vol. 90, UK.

Hawash, Methodology for Selective Adsorption of Lithium Ions onto polymeric Aluminum (III) Hydroxide, Journal of American Science, 2010 pp. 301-309, vol. 6.

(56) References Cited

OTHER PUBLICATIONS

Kawai, Solvent Extraction ofsinc (ii) and manganese(II) with 5, 10, 15, 20-tetrapheny1-21H, 23H-porphone (TPP) through the metal exchange reaction of lead(II)-TPP, 7 Solvent Extr. Res. Dev. Japan (200), pp. 36-43.
Ku, The Adsorption of Flouride Ion From Aqueous Solution by Activated Alumina, Water, Air, and Soil Pollution, 2002, pp. 349-360, vol. 133, Netherlands.
Lee, Solvent extraction of Zinc from Strong hydrochloric acid solution with alamine 336, 30(7) Bull Korean Chem. Soc. (2009), pp. 1526-1530.
Manceau, Nanometer sized, divalent MN, hydrous silicate domains in geothermal brine precipitates, American Mineraologist, 2005, vol. 90, pp. 371-381.
Menzheres, Solid State Interaction of Aluminium Hydroxide with Lithium Salts, Journal of Materials Synthesis and Processing, 1989, pp. 239-244, vol. 7, No. 4, Plenum Publishing Corp, US.
Nan, Recovery of metal values from spent lithium ion batteries with chemical deposition and solvent extraction. Journal of Power Sources, 2005, pp. 278-284, vol. 152, UK.
Pascua, Uptake of dissolved arsenic during the retrieval of silica from spent geothermal brine, Geothermics, 2007, vol. 36, pp. 230-242.
Potapov, Silica Precipitation from Hydrothermal Solution, Journal of Mining Science, 2004, vol. 40, No. 1, pp. 101-112.
Rokuyev, Mutual Influence of Zinc(II) and Cadmium (II) in Case of Extraction from Lithium Chloride Solutions with Tributyl Phosphate.
Pyman, The Point of Zero Charge of Amorphouse Coprecipitates of Silica with Hydrous Aluminium or Ferric Hydroxide, Caly Minerals, 1979, pp. 87-92, vol. 14 Western Australia.
Ryabstev, Sorption of Lithium from Brine Onto Grandular LiCI-2A1(OH)3-mH2O Sorbent Under Synamic Conditions, Russian Journal of Applied Chemistry, 2002, pp. 1069-1074, vol. 75, No. 7, RU.
Ryabstev, Preparation of high-purity lithium hydroxide monohydrate from technical grade lithium carbonate by membrane electrolysis.
Samoilov, Extracting Lithium from Waste Solutions of Chemico-Metallurgical Lithium Carbonate Production. Theoretical Foundations of Chemical Engineering, 2008, pp. 714-717, vol. 42, No. 5, RU.
Schultze, Techniques for Recovering Metal Values From Postflash Geothermal Brines, Trasnactions Geothermal Resources Council, 1984, pp. 2-5, vol. 8, Bureua of Mines, Reno, Nevada.
Schultze, Operation of Mineral Recovery Unit on Brine from the Salton Sea known Geothermal Resources Council, 1984, pp. 2-5, vol. 8, Bureau of Mines, Reno, Nevada.
Sheikholeslami, Silica and metals removal by pretreatment to prevent fouling of reverse osmosis membranes, Desalination, 2002, pp. 255-267, vol. 143, Elsevier.
Song, Materials Research bulletin, 37, 2002, 1249-1257.
Umetani, Solvent Extractions of Lithium and Sodium with 4-Benzoyl or 4-Perfluoracy1-5-Pyrazolone and Topo, Talanta, 1987, pp. 779-782, vol. 34, No. 9, Pergamon Journals Ltd., Great Britain.
Wilcox, Selective lithium ion extraction with chromogenic monoaza crown ethers, Analyica Chimica Acta, 1991, pp. 235-242, vol. 245, Elsevier Science Publishers, B.V., Amserdam, The Netherlands.
Yang, Optimization of operation conditions for extracting lithium ions from calcium chloride type oilfield brine, International Journal of Minerals, Metallurgy, and Materials, 2012, pp. 290-294, vol. 19, Issue 4, US.
Yokohama, A Study of the Alumina-Silica Gel Adsorbent for Removal of Silicic Acid from Geothermal Water: Increase in Adsoprtion Capacity of the Adsorbent due to Formation of Amorphous Aluminosilicate vy Adsoprtion of Silicic Acid, Journal of Colloid and Interface Science, 2002, pp. 1-5, vol. 252, Elsevier, US.

* cited by examiner

SELECTIVE REMOVAL OF SILICA FROM SILICA CONTAINING BRINES

RELATED APPLICATIONS

This application claims priority to U.S. Provisional Patent Application Ser. No. 61/239,275, filed on Sep. 2, 2009, which is incorporated herein by reference in its entirety.

BACKGROUND OF THE INVENTION

1. Technical Field of the Invention

This invention generally relates to the field of selectively removing silica from silica containing solutions. More particularly, the invention relates to methods for the selective removal and recovery of silica and silicates from containing brines, preferably without the removal of other ions from the brines. Finally, the invention relates to methods for preventing scale buildup in geothermal power plants and processes employing geothermal brines.

2. Description of the Prior Art

Geothermal brines are of particular interest for a variety of reasons. First, geothermal brines provide a source of power due to the fact that hot geothermal pools are stored at high pressure underground, which when released to atmospheric pressure, can provide a flash-steam. The flash-stream can be used, for example, to run a power plant. Additionally, geothermal brines contain useful elements, which can be recovered and utilized for secondary processes. In some geothermal waters and brines, binary processes can be used to heat a second fluid to provide steam for the generation of electricity without the flashing of the geothermal brine.

It is known that geothermal brines can include various metal ions, particularly alkali and alkaline earth metals, as well as lead, silver and zinc, in varying concentrations, depending upon the source of the brine. Recovery of these metals is potentially important to the chemical and pharmaceutical industries. Typically, the economic recovery of metals from natural brines, which may vary widely in composition, depends not only on the specific concentration of desired the desired metal, but also upon the concentrations of interfering ions, particularly silica, calcium and magnesium, because the presence of the interfering ions will increase recovery costs as additional steps must be taken to remove the interfering ions.

Silica is known to deposit in piping as scale deposits, typically as a result of the cooling of a geothermal brine. Frequently, geothermal brines are near saturation with respect to the silica concentration and upon cooling, deposition occurs because of the lower solubilities at lower temperatures. This is combined with the polymerization of silica and co-precipitation with other species, particularly metals. This is seen in geothermal power stations, and is particularly true for amorphous silica/silicates. Additionally, silica is a known problem in RO desalination plants. Thus, removal of silica from low concentration brines may help to eliminate these scale deposits.

Known methods for the removal of silica from geothermal brines include the use of a geothermal brine clarifier for the removal and recovery of silica solids, that can be precipitated with the use of various seed materials, or the use of compounds that absorb silica, such as magnesium oxide, magnesium hydroxide or magnesium carbonate. In addition to a less than complete recovery of silicon from brines, prior art methods also suffer in that they typically remove ions and compounds other than just silica and silicon containing compounds.

Thus, although conventional methods employed in the processing of ores and brines currently can remove some of the silica present in silica containing solutions and brines, there exists a need to develop methods that are selective for the removal of silica at high yields.

SUMMARY OF THE INVENTION

Methods for the selective removal of silica from silica containing solutions, such as geothermal brines, are provided. Also provided are methods for preventing scale deposit formation in geothermal power equipment.

In one aspect, a method for preventing silica scale in geothermal brine reinjection wells by selectively removing silica from a geothermal brine solution is provided. The method includes the steps of: obtaining a geothermal brine solution comprising silica from a geothermal well; maintaining the pH of the geothermal brine solution at an adjusted pH of between 4 and 7; contacting the geothermal brine solution at adjusted pH silica with activated alumina, such that silica present in the geothermal brine solution selectively binds to the activated alumina; recovering an aqueous brine product stream from the contacting step, said aqueous product stream having a reduced silica concentration relative to the geothermal brine solution; and injecting the aqueous brine product stream into the geothermal well.

In a second aspect, a method for preventing silica scale in geothermal brine reinjection wells by selectively removing silica from a geothermal brine solution is provided. The method includes the steps of: obtaining a geothermal brine solution from a geothermal well that includes silica and an iron (II) salt; oxidizing the iron (II) salt to iron (III) hydroxide; maintaining the pH of the geothermal brine solution at an adjusted pH of between 4.5 and 6; contacting the silica and the iron (III) hydroxide at the adjusted pH for a time sufficient for the silica to attach to the iron (III) hydroxide and form a solid fraction that includes a silica/iron precipitate and a liquid fraction, wherein the liquid fraction includes a geothermal brine product stream having a decreased concentration of silica and iron relative to the geothermal brine; separating the silica/iron precipitate from the liquid fraction; and injecting the liquid fraction into the geothermal well.

DETAILED DESCRIPTION OF THE INVENTION

Figure 1:
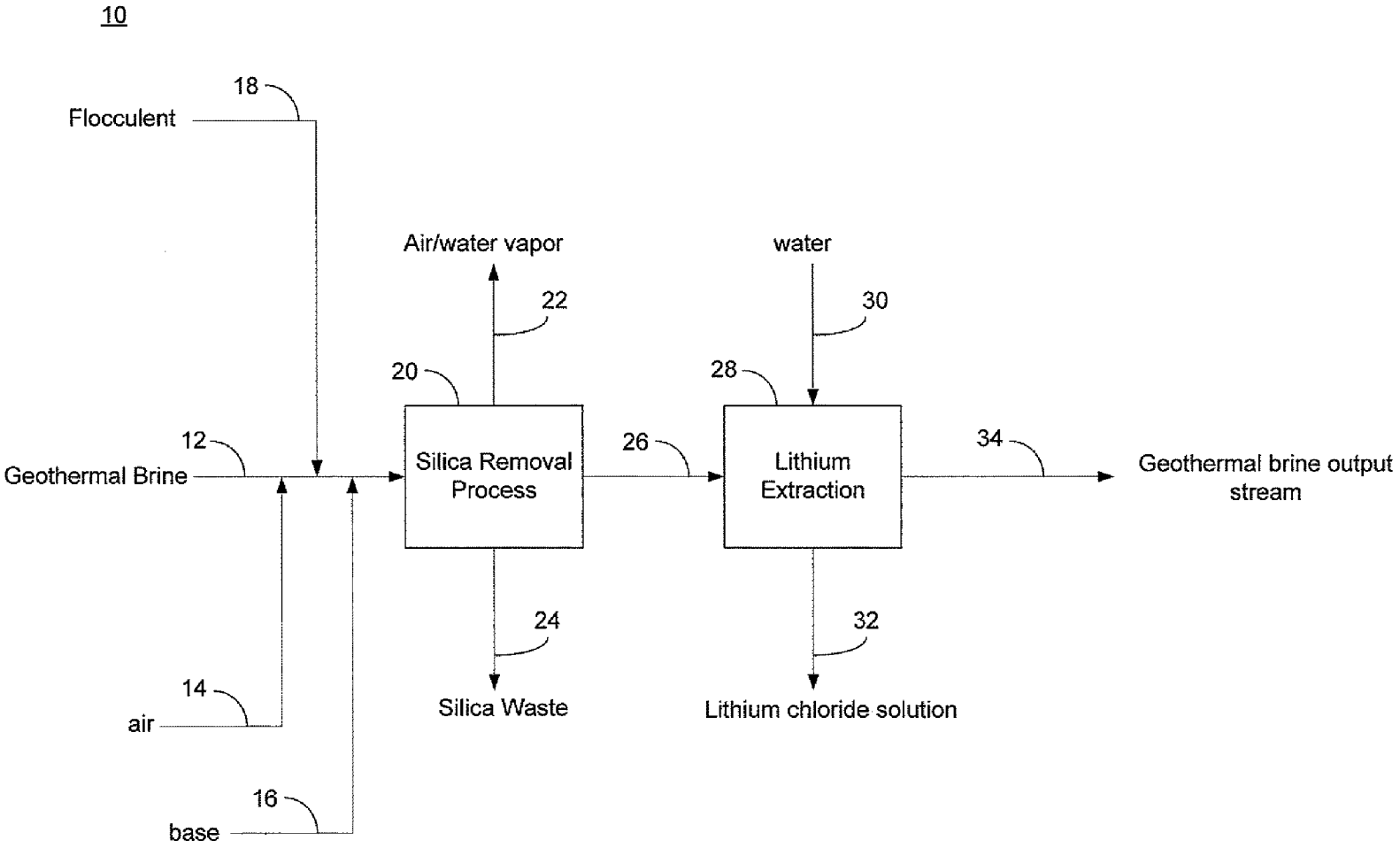
FIG. 1 is an illustration of one embodiment of the present invention.

Broadly, described herein are methods for the selective removal of silica and silicates (typically reported as silicon dioxide) from solution. As used herein, the selective removal of silica generally refers to methods to facilitate the removal of silica from solutions, such as geothermal brines, without the simultaneous removal of other ions. Broadly described, in certain embodiments, the methods described herein employ chemical means for the separation of silica. The removal of silica from solutions, such as geothermal brines, can prevent, reduce or delay scale formation as silica present in brines may form scale deposits. It is known that scale deposit formation is a common problem with geothermal brines and therefore the methods described herein for the selective removal of silica can be utilized to prevent scale formation in geothermal power equipment. Additionally, the removal of silica from solutions, such as geothermal brines, also facilitates the subsequent recovery of various metal ions from the solution, such as lithium, manganese, and zinc, as well as boron, cesium, potassium, rubidium, and silver. It is understood that the recovery of valuable metals from a geothermal brine depends upon the concentration of a metal in the brine, and the economics of the recovery thereof, which can vary widely among brines. The prevention, reduction, and/or delay of scale production in geothermal wells and geothermal power plant equipment can result in increased geothermal production by improving the equipment lifetime and reducing the frequency of equipment maintenance.

As used herein, brine solution refers to an aqueous solution that can include one or more alkali and/or alkaline earth metal salt(s), wherein the concentration of alkali or alkaline earth metal salt can vary from trace amounts up to the point of saturation. Typically brine solutions include multiple metal salts dissolved therein. Generally, brines suitable for the methods described herein are aqueous solutions that may include alkali metal or alkaline earth chlorides, bromides, sulfates, hydroxides, nitrates, and the like, as well as natural brines. In certain brines, metals may be present. Exemplary elements present in the geothermal brines can include sodium, potassium, calcium, magnesium, lithium, strontium, cesium, rubidium, barium, iron, boron, silica, manganese, chlorine, zinc, aluminum, antimony, chromium, cobalt, copper, lead, arsenic, mercury, molybdenum, nickel, silver, thallium, vanadium, and fluorine, although it is understood that other elements and compounds may also be present. Brines can be obtained from natural sources, such as, Chilean brines, Smackover brines, or Salton Sea brines, geothermal brines, sea water, mineral brines (e.g., lithium chloride or potassium chloride brines), alkali metal salt brines, and industrial brines, for example, industrial brines recovered from ore leaching, mineral dressing, and the like. The present methods are equally applicable to artificially prepared brine or salt solutions, as well as waste water streams.

Typically, in geothermal power plants, heat is recovered from a geothermal brine through the use of one or more flash tanks. In certain embodiments, a silica precipitate seed can be supplied to the geothermal brine prior to the brine being supplied to the flash tanks to remove at least a portion of the silica present. In certain embodiments, the silica precipitate seed can result in the removal of up to 25% of the silica present in the brine, alternatively up to about 40% of the silica present in the brine, alternatively up to about 50% of the silica present in the brine, alternatively up to about 60% of the silica present in the brine, or alternatively greater than about 60% of the silica present in the brine. In certain embodiments, the silica precipitate seed can reduce the silica concentration of the brine to less than about 200 ppm, alternatively less than about 175 ppm, alternatively to about 160 ppm.

The geothermal brine supplied to the flash tanks is typically supplied at a temperature of at least about 250° C., alternatively at least about 300° C. After flashing of the geothermal brine and the recovery of significant heat and energy therefrom, the geothermal brine can be supplied to a silica management process (as further described herein) for the removal of additional silica. As noted previously, the removal of silica can prevent, reduce or delay the buildup of scale, thereby increasing the lifetime of the equipment. Typically, the temperature of the brine has been reduced to less than about 150° C. before it is supplied to one of the silica removal processes described herein, alternatively less than about 125° C., alternatively less than about 120° C., alternatively less than about 115° C., alternatively less than about 110° C., alternatively less than about 105° C., or alternatively less than about 100° C.

While the removal of silica from geothermal brines in geothermal power plants is useful for reducing scale buildup in the power plant, supplying the brine to one or more of the silica removal processes described herein also has the effect of reducing the reinjection temperature of the brine to less than about 100° C., alternatively less than about 90° C., alternatively less than about 80° C., alternatively less than about 75° C., or alternatively less than about 70°.

While the removal of silica from geothermal brines used in geothermal power plants is an important step for reducing or preventing the buildup of scale, the removal of silica is also useful for many other processes, such as the recovery of lithium, manganese, zinc or other metals from geothermal and other brines. Other useful processes are also known in the art. In certain embodiments, silica is preferably selectively removed such that the silica can be further refined or supplied to an associated process, without the need for extensive purification thereof. Processes for the removal of silica are commonly known as silica management.

As described herein, the selective silica recovery of the present invention can include the use of activated alumina, aluminum salts (such as $AlCl_3$), or iron (III) hydroxide.

In certain embodiments of the present invention, the brine or silica containing solution can first be filtered or treated to remove solids present prior to the selective recovery and removal of silica.

As described herein, a simulated brine was prepared in an attempt to simulate the brine composition of various Hudson Ranch test wells found in the Salton Sea (California, U.S.). Generally, the simulated brine is an aqueous solution having a composition of about 260 ppm lithium, 63,000 ppm sodium, 20,100 ppm potassium, 33,000 ppm calcium, 130 ppm strontium, 700 ppm zinc, 1700 ppm iron, 450 ppm boron, 54 ppm sulfate, 3 ppm fluoride, 450 ppm ammonium ion, 180 ppm barium, 160 ppm silicon dioxide, and 181,000 ppm chloride. Additional elements, such as manganese, aluminum, antimony, chromium, cobalt, copper, lead, arsenic, mercury, molybdenum, nickel, silver, thallium, and vanadium, may also be present in the brine.

Selective Silica Recovery by Precipitation with Iron

In one embodiment, silica can be removed a brine by contacting the brine with iron (III) hydroxide at a pH of between about 4.5 and 6, preferably between about 4.75 and 5.5, more preferably between about 4.9 and 5.3.

A synthetic brine can be prepared having the approximate composition provided herein for the simulated Salton Sea test wells, and further including about 1880 ppm manganese. In certain embodiments, the brine will have an iron (II) salt, such as iron (II) chloride, naturally present in a concentration, for example, of greater than about 1000 ppm. In other embodiments, an iron (II) salt or iron (III) hydroxide can be added to the brine to achieve a certain concentration of iron (II) salt or iron (III) hydroxide relative to the silica or silicon containing compounds present in the brine. In certain embodiments, the molar ratio of the iron (II) salt or iron (III) hydroxide to silica is at least about 1:1, preferably at least about 4:1, more preferably at least about 7:1 and even more preferably at least about 10:1.

When the iron in the brine or silica containing solution is iron (II), for example iron (II) chloride, an oxidant can be added to oxidize iron (II) salt to iron (III) hydroxide. Exemplary oxidants include hypohalite compounds, such as hypochlorite, hydrogen peroxide (in the presence of an acid), air, halogens, chlorine dioxide, chlorite, chlorate, perchlorate and other analogous halogen compounds, permanganate salts, chromium compounds, such as chromic and dichromic acids, chromium trioxide, pyridinium chlorochromate (PCC), chromate and dichromate compounds, sulfoxides, persulfuric acid, nitric acid, ozone, and the like. While it is understood that many different oxidants can be used for the oxidation of iron (II) to iron (III), in a preferred embodiment, oxygen or air is used as the oxidant and lime or a like base is used to adjust and maintain the pH to a range of between about 4 and 7. This pH range is selective for the oxidation of the iron (II) salt to iron (III) hydroxide, and generally does not result in the co-precipitation or co-oxidation of other elements or compounds present in the brine. In one preferred embodiment, the iron (II) salt can be oxidized to iron (III) by sparging the reaction vessel with air. Air can be added at a rate of at least about 10 cfm per 300 L vessel, preferably between about 10 and 50 cfm per 300 L vessel. It will be recognized by those skilled in the art that iron (III) hydroxide may also have a significant affinity for arsenic (III) and (V) oxyanions, and these anions, if present in the brine, may be co-deposited with the silica on the iron (III) hydroxide. Thus, in these embodiments, steps may have to be employed to either remove arsenic from the brine prior to silica management.

In another embodiment, iron (III) hydroxide can be produced by adding a solution of iron (III) chloride to the brine, which upon contact with the more neutral brine solution, will precipitate as iron (III) hydroxide. The resulting brine may require subsequent neutralization with a base to initiate precipitation of the silica. In certain embodiments, iron (III) hydroxide can be contacted with lime to form insoluble ferric hydroxide solids, which can be adsorbed with silica.

The iron (III) hydroxide contacts the silica present in the silica containing solution, to form a precipitate. Without being bound to any specific theory, it is believed that the silica or silicon containing compound attaches to the iron (III) hydroxide. In certain embodiments, the ratio of iron (III) to silica is at least about 1:1, more preferably at least about 4:1, more preferably at least about 7:1. In other embodiments, it is preferred that the iron (III) hydroxide is present in a molar excess relative to the silica. The reaction of the iron (III) hydroxide with silica is capable of removing at least about 80% of the silica present, preferably at least about 90%, and more preferably at least about 95%, and typically depends upon the amount of iron (III) hydroxide present in the solution.

In certain embodiments, the pH can be monitored continually during the reaction of iron (III) with silica and acid or base is added, as needed, to maintain the pH the desired level, for example, between about 4.9 and 5.3. In alternate embodiments, a pH of between about 5.1 and 5.25 is maintained. In certain embodiments, a pH of about 5.2 is maintained.

In certain embodiments, the iron (II) salt containing solution is sparged with air for a period of at least about 5 minutes, alternately at least about 10 minutes, alternately at least about 15 minutes, and preferably at least about 30 minutes, followed by the addition of a base, such as calcium oxide, calcium hydroxide, sodium hydroxide, or the like, to achieve the desired pH for the solution. In certain embodiments, the base can be added as an aqueous solution, such as a solution containing between about 10 and 30% solids by weight.

In certain embodiments, a flocculent, such as the Magnafloc® products from Ciba®, for example Magnafloc 351, or a similar flocculent can be added in the clarification step. The flocculent can be added in an aqueous solution in amounts between about 0.005% by weight and about 1% by weight. The flocculent can be added at a rate of at least 0.001 gpm, preferably between about 0.001 and 1 gpm, based upon a 300 L vessel. In certain embodiments, the flocculent is a non-ionic flocculent. In other embodiments, the flocculent is a cationic flocculent. In certain embodiments, it is believed that non-ionic and cationic flocculents may be useful for use with iron precipitates. In certain embodiments, Cytec Superfloc-N flocculents, such as the N-100, N-100 S, N-300, C-100, C-110, C-521, C-573, C-577 and C581 may be used for the recovery of iron and silica precipitates, according to the present invention. In other embodiments, flocculent products from Nalco, such as CAT-Floc, MaxiFloc, Nalco 98DF063, Nalco 1317 Liquid, Nalco 97ND048, Nalco 9907 Flocculent, Nalco 73281, and Nalco 9355 may be used with the present invention.

The rate of the addition of the air, base and flocculent is based upon the size of the reactor and the concentrations of iron and silica. Generally, the rates of addition of the components is proportional to the other components being added and the size of the reaction vessels. For example, to a geothermal brine, having iron and silica present, which is supplied at a rate of about 6 gpm (gallons per minute) to a silica removal process having a overall capacity of about 900 gal., air can be added at a rate of about 100 cfm, a 20% solution of calcium oxide in water can be added at a rate of about 0.5 lb/min, and a 0.025% solution of Magnafloc 351 (flocculent) at a rate of about 0.01 gpm.

Selective Silica Recovery with Activated Alumina

Activated alumina ($\gamma$-$Al_2O_3$) is known as an absorbent for silica. Specifically, activated alumina has been utilized in the removal of silica from raw water, such as water that is fed to a boiler. However, until now, activated alumina has not been used for the removal of silica from brine solutions, wherein the removal of the silica does not also result in the removal of other ions or compounds by the activated alumina. Put different, until now, methods have not been reported for the selective removal of silica from brine solutions without concurrent removal of other ions or compounds.

Activated alumina is a known absorbent for organic and inorganic compounds in nonionic, cationic and anionic forms. Indeed, activated alumina is a common filter media used in organic chemistry for the separation and purification of reaction products.

Thus, in another embodiment of the present invention, silica can be removed by contacting with activated alumina at a pH of between about 4.5 and 7, alternatively between about 4.75 and 5.75, or in certain embodiments, between about 4.8 and 5.3. The activated alumina can have a BET surface area of between about 50 and 300 $m^2/g$. In certain embodiments, the silica containing solution can be combined and stirred with activated alumina to selectively remove the silica. In alternate embodiments, the activated alumina can be added to the solution and stirred to selectively remove silica and silicon containing compounds. In certain embodiments, the pH of the solution can be maintained at between about 4.5 and 8.5, preferably between about 4.75 and 5.75, and more preferably between about 4.8 and 5.3, during the step of contacting the silica with the activated alumina. In certain embodiments, the pH can be maintained at between about 4.75 and 5.25. Alternatively, the pH can be maintained at between about 5.25 and 5.75. Alternatively, the pH can be maintained at between about 5.75 and about 6.25. A pH meter can be used to monitor the pH before, during and after the contacting step. In certain embodiments, the pH is controlled by titrating the solution with a strong base, such as sodium hydroxide. In one exemplary embodiment, an approximately 0.1M solution of sodium hydroxide is used to adjust the pH of the reaction, although it is understood that a base of higher or lower concentration can be employed.

Regeneration of the activated alumina can be achieved by first washing the alumina with a strong base, for example, a sodium hydroxide solution of at least about 0.01 M, followed by the subsequent washing with a strong acid, for example, a hydrochloric acid solution of at least about 0.01 M. In some embodiments, regeneration can be followed by treatment with a sodium fluoride solution having a pH of between about 4 and 5, to completely recover the capacity of the activated alumina. Optionally, the column can be rinsed with water, preferably between 1 and 5 volumes of water, prior to contacting with sodium hydroxide.

In certain embodiments, wherein the silica containing solution can be contacted with the activated alumina in a column, the solution exiting the column can be monitored to determine loading of the activated alumina.

In certain embodiments, the silica removal process can be associated with another process to recover certain elements from a treated geothermal brine stream having a reduced concentration of silica, and preferably a reduced concentration of silica and iron. Exemplary elements suitable for recovery can include lithium, manganese, and zinc, although other elements may be recovered as well.

For example, as shown in FIG. 1, process 10 for the removal of silica and iron from a geothermal brine, followed by the subsequent removal of lithium, is provided. In an exemplary embodiment, geothermal brine 12, having a silica concentration of at least about 100 ppm, an iron concentration of at least about 500 ppm, and a recoverable amount of lithium or other metal, is supplied with air 14, base stream 16, and flocculent stream 18 to a silica removal process 20.

Silica removal process 20 can produce brine solution 26 having a lower concentration of silica, and in certain embodiments iron, than the initial geothermal brine, as well as a reaction by-product stream 24 that includes silica that was previously present in the geothermal brine. Additionally, air/water vapor are produced and removed via line 22.

The brine solution 26 having a decreased concentration of silica and iron can be supplied to a lithium recovery process 28. The lithium recovery process can include a column or other means for contacting the geothermal brine with a extraction material suitable for the extraction and subsequent release of lithium. In certain embodiments, the extraction material can be a lithium aluminate intercalate, an inorganic materials with a layered crystal structure that is both highly selective for lithium and economically viable. Exemplary lithium intercalate materials can include a lithium aluminate intercalate/gibbsite composite material, a resin based lithium aluminate intercalate and a granulated lithium aluminate intercalate. The gibbsite composite can be a lithium aluminate intercalate that is grown onto an aluminum trihidrate core. The resin-based lithium aluminate intercalate can be formed within the pores of a macroreticular ion exchange resin. The granulated lithium aluminate intercalate can consist of fine-grained lithium aluminate intercalate produced by the incorporation of a small amount of inorganic polymer.

The process of contacting the lithium aluminate intercalate material with the geothermal brine is typically carried out in a column that includes the extraction material. The geothermal brine can be flowed into the column and lithium ions are captured on the extraction material, while the water and other ions pass through the column as geothermal brine output stream 34. After the column is saturated, the captured lithium is removed by flowing water supplied via line 30, wherein the water can include a small amount of lithium chloride present, through the column to produce lithium chloride stream 32. In preferred embodiments, multiple columns are employed for the capture of the lithium.

Alternate processes for the removal of silica can also be employed. For example, in certain embodiments, silica can be removed by controlling the pH of the solution and contacting silica with $AlCl_3$. The method can include the steps of: providing a brine solution that includes silica; contacting the brine solution that includes silica with an aqueous solution, wherein the aqueous solution includes aluminum chloride to produce a second aqueous solution, wherein the second aqueous solution including brine and aluminum chloride; adjusting and maintaining the pH of the second aqueous solution such that the pH is between about 4.5 and 5.5, thereby allowing the formation of an aluminosilicate precipitate; removing the aluminosilicate precipitate that forms from the second aqueous solution; and recovering an aqueous product stream, said aqueous product stream having a reduced silica concentration relative to the brine solution.

EXAMPLES

1. Selective Removal of Silica Using Ferrous Iron

A simulated brine was prepared to simulate the brine composition of Hudson Ranch test wells, having an approximate composition of about 252 ppm lithium, 61,900 ppm sodium, 20,400 ppm potassium, 33,300 ppm calcium, 123 ppm strontium, 728 ppm zinc, 1620 ppm iron, 201 ppm boron, 322 ppm sulfate, 3 ppm fluoride, 201 ppm barium, 57 ppm magnesium, 1880 ppm manganese, 136 ppm lead, 6 ppm copper, 11 ppm arsenic, 160 ppm silicon dioxide, and 181,000 ppm chloride. The simulated brine (1539.2 g) was sparged with air for about 60 min., during which time pH was measured. A calcium hydroxide slurry having 20% solids by weight was added dropwise after 60, 90 and 120 minutes (total weight of the calcium hydroxide slurry added of 13.5 g, 2.7 g dry basis) to the solution. The pH was monitored throughout the reaction and was initially allowed to fall, and was then adjusted to a pH of about 5 with the addition of calcium hydroxide after 60 minutes, and maintained at about a pH of 5 thereafter. The reaction was allowed to stir while the pH was maintained at about 5. Total reaction time was about 180 min. A white precipitate was collected, washed and weighed, providing a yield of about 95% recovery of the silica present in the brine and about 100% of the iron present in the brine.

2. Selective Removal of Silica Using Activated Alumina

A 50 mL brine solution having approximately 180 ppm dissolved silica was passed through a 2.5 cm diameter column filled to a depth of 20 cm and containing approximately 0.5 g activated alumina and about 1.2 g water. The silica preferentially adsorbed onto the alumina and was removed from solution. The activated alumina had a surface area of about 300 $m^2/g$ and a grain size of between about 8-14 mesh (~2 mm diameter). The total bed volume was about 102 mL. The temperature during the step of contacting the silica containing brine and the activated alumina was maintained between about 90 and 95° C.

The concentration of silica in the brine was monitored by measuring monomeric silica using the molybdate colorimetric method and using Atomic Absorption for total silica. Silica values were significantly lower in the exit solution due to adsorbence of the silica on the activated alumina. Saturation of the activated alumina in the column was indicated by a sudden increase in silica concentration in the exit solution. A total loading of about 1.8% by weight of silica (SiO2) on the activated alumina was achieved.

To regenerate the alumina for another cycle of silica removal, the alumina was first washed with 5 bed volumes of dilute water in order to remove salt solution remaining in the pores. This removed only a small amount of silica from the alumina. The alumina was then reacted with a dilute (0.1M) sodium hydroxide solution at a temperature of between about 50-75° C. until a desired amount of silica has been removed. The alumina was then rinsed with between about 2-3 bed volumes of dilute acid to prepare the surface for the next silica adsorption cycle.

3. Continuous Processing of Geothermal Brine

Figure 2:
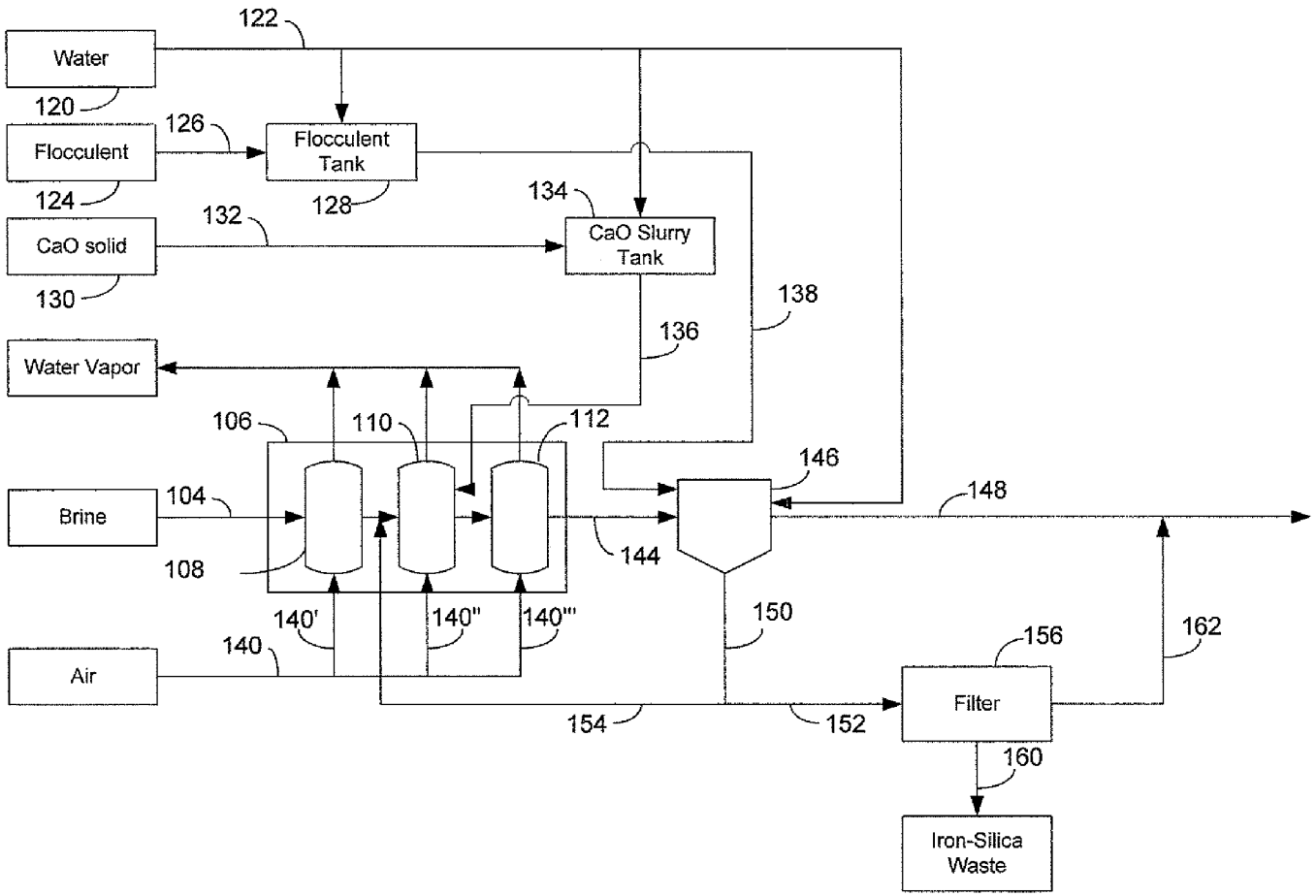
FIG. 2 is an illustration of a second embodiment of the present invention.

As shown in FIG. 2, a continuous process for the management of silica is provided. Silica management system 106 includes three stirred vessels provided in series 108, 110, 112. To first reactor 108 is provided a geothermal brine via line 104 having an iron content of approximately 1500 ppm and a silica content of about 160 is added at a rate of about 6 gpm. Approximately 100 cfm of air is supplied via line 140 to each reactor 108, 110, 112 and is sparged through the geothermal brine. The brine supplied to each of the three reactors is maintained at a temperature of about 95° C.

An aqueous calcium oxide slurry is prepared by mixing solid calcium oxide proved from tank 130 via line 132 to vessel 134, where the solid is mixed with water 120 provided via line 122. The calcium oxide slurry includes between about 15 and 25% by weight, alternatively about 20% by weight, calcium oxide, and is supplied to second reactor 110 at a rate on a wet basis of about 0.5 lb/min.

In silica management system 106, brine is supplied to first vessel 108 where the brine is sparged with air via line 140. The brine is then supplied from first vessel 108 to second vessel 110. The brine in second vessel 110 is contacted with calcium oxide supplied via line 136 and is again sparged with air supplied via line 140. The brine is then supplied from second vessel 110 to third vessel 112 where it is again sparged with air supplied via line 140. The air to all vessels is supplied at a constant rate, preferably 100 cfm.

After the addition of the air via line 140' to first reactor 108, the pH drops to between about 2.3 and 3.5. Air is added to second reactor 110 via line 140" at a rate of about 100 cfm and a charge of approximately 15-25% by weight of an aqueous calcium oxide slurry at a rate of about 0.5 lb/minute, which can raise the pH in the second reactor to between about 4.8 and 6.5, and preferably between about 5.0 and 5.5. The addition of calcium oxide slurry initiates the precipitation of iron (III) hydroxide and iron silicate. To third reactor 112, air is added via line 140'" at a rate of about 100 cfm. Each of the three reactors includes means for stirring to ensure sufficient mixing of the brine, base and air oxidant.

The continuous addition of air and base to the reaction vessel results in the precipitation of the iron and silica at rates up to about 0.5 lb/minute, depending upon the concentration of iron and silica in the geothermal brine.

The geothermal brine, which now includes precipitates of iron (III) hydroxide and iron silicate, is then supplied from third vessel 112 to clarifier 146 via line 144. Water may be added to clarifier 146 via line 122. An aqueous flocculent solution of Magnafloc 351, in a concentration between about 0.005% and 1% by weight, such as about 0.025% by weight, is prepared by supplying solid flocculent 124 via line 126 to flocculent tank 128, where the solid is contacted with water 120 supplied via line 122. The aqueous flocculent solution is supplied to clarifier vessel 146 via line 138 at a rate of about 0.01 gpm.

From clarifier 146 is produced two streams. First clarifier product stream 148 includes the geothermal brine having a reduced concentration of silica and iron, and may be supplied to a secondary process, such as lithium recovery. Second clarifier product stream 150 includes solid silica-iron waste, as well as some geothermal brine. Stream 150 can be supplied via line 152 to filter process 156 which serves to separate the solid silica-iron waste 160 from the liquid brine 162. Alternately, stream 150 can be resupplied to second vessel 110 via line 154.

As is understood in the art, not all equipment or apparatuses are shown in the figures. For example, one of skill in the art would recognize that various holding tanks and/or pumps may be employed in the present method.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

As used herein, recitation of the term about and approximately with respect to a range of values should be interpreted to include both the upper and lower end of the recited range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

I claim:

1. A method for preventing silica scale in geothermal brine reinjection wells by selectively removing silica from a geothermal brine solution, the method comprising the steps of:

obtaining a geothermal brine solution comprising silica;

maintaining the pH of the geothermal brine solution at a pH of between 4 and 6.25;

contacting the geothermal brine solution comprising silica with activated alumina, such that silica present in the geothermal brine solution selectively binds to the activated alumina;

recovering an aqueous brine product stream from the contacting step, said aqueous product stream having a reduced silica concentration relative to the geothermal brine solution; and injecting the aqueous brine product stream into the geothermal well, the aqueous brine product stream comprising less than about 80 ppm of silica.

2. The method of claim 1, wherein the aqueous brine product stream comprises less than about 35 ppm of silica.

3. The method of claim 1, wherein the aqueous brine product stream comprises less than about 20 ppm of silica.

4. The method of claim 1, wherein the aqueous brine product stream comprises less than about 10 ppm of silica.

5. The method of claim 1, wherein the geothermal brine solution comprising silica has a silica concentration of between about 150 ppm and 250 ppm.

6. The method of claim 1, wherein the geothermal brine solution is contacted with the activated alumina at a temperature of less than about 100° C.

7. The method of claim 1, further comprising a step prior to injecting the aqueous brine product stream, of supplying at least a portion of the aqueous brine product stream to a process for recovery of lithium.

8. The method of claim 1, further comprising a step prior to injecting the aqueous brine product stream, of supplying at least a portion of the aqueous brine product stream to a process for recovery of manganese or zinc.

9. A method for preventing silica scale in geothermal brine reinjection wells by selectively removing silica from a geothermal brine solution, the method comprising the steps of:

obtaining a geothermal brine solution containing silica and an iron (II) salt;

oxidizing the iron (II) salt to iron (III) hydroxide;

maintaining the pH of the geothermal brine solution at an adjusted pH of between 4.5 and 6.5;

contacting the silica and the iron (III) hydroxide at the adjusted pH for a time sufficient for the silica to attach to the iron (III) hydroxide and form a solid fraction containing a silica/iron precipitate and a liquid fraction, wherein the liquid fraction contains a geothermal brine product stream having a decreased concentration of silica and iron relative to the geothermal brine;

separating the silica/iron precipitate from the liquid fraction; and injecting the liquid fraction into the geothermal well, the liquid fraction comprising less than about 80 ppm of silica.

10. The method of claim 9, wherein the liquid fraction comprises less than about 35 ppm of silica.

11. The method of claim 9, wherein the liquid fraction comprises less than about 20 ppm of silica.

12. The method of claim 9, wherein the liquid fraction comprises less than about 10 ppm of silica.

13. The method of claim 9, wherein the liquid fraction further comprises less than about 15 ppm of iron.

14. The method of claim 9, wherein the liquid fraction comprises less than about 10 ppm of silica and less than about 10 ppm of iron.

15. The method of claim 9, further comprising a step prior to injecting the liquid fraction, of supplying at least a portion of the liquid fraction to a process for recovery of lithium.

16. The method of claim 9, wherein the geothermal brine comprising silica has a silica concentration of between about 150 ppm and 250 ppm.

* * * * *